US005480339A

United States Patent [19]

Wu

[11] Patent Number: 5,480,339

[45] Date of Patent: Jan. 2, 1996

[54] AUTOMATICALLY INFLATABLE TOY

[75] Inventor: Teng-Hui Wu, Taipei, Taiwan

[73] Assignee: Chieh Chang Co., Ltd., Taiwan

[21] Appl. No.: 368,020

[22] Filed: Jan. 3, 1995

[51] Int. Cl.[6] ..... A63H 27/10

[52] U.S. Cl. ..... 446/220; 472/54

[58] Field of Search ..... 446/220, 226, 446/221, 156, 163; 472/54

[56] References Cited

U.S. PATENT DOCUMENTS

| | | | |
|---|---|---|---|
| 4,758,198 | 7/1988 | Ishiwa | 446/220 |
| 4,898,561 | 2/1990 | Nottingham et al. | 446/220 |
| 5,083,961 | 1/1992 | Ishiwa | 446/220 X |

*Primary Examiner*—Mickey Yu
*Attorney, Agent, or Firm*—Peterson, Wicks, Nemer & Kamrath

[57] ABSTRACT

Disclosed is an automatically inflatable toy which mainly includes an inflatable toy made of multi-layered laminated material consisting of nylon, LLDPE, PET, etc., an adequate amount of powder type sodium bi-carbonate contained in a cloth bag and disposed inside the inflatable toy, an adequate amount of citric acid solution contained in a small and thin bag made of compound material of OPP and PP and disposed inside the powdered sodium bi-carbonate, and an outer package which can be designed with various shapes and patterns. When the package is squeezed, the small and thin bag is broken and the citric acid solution therein is let out to mix with the powdered sodium bi-carbonate to produce large amount of carbon dioxide which seeps through the pores of the cloth bag and inflates the inflatable toy and causes the same to burst out the outer package from a weakening line provided on the package.

1 Claim, 3 Drawing Sheets

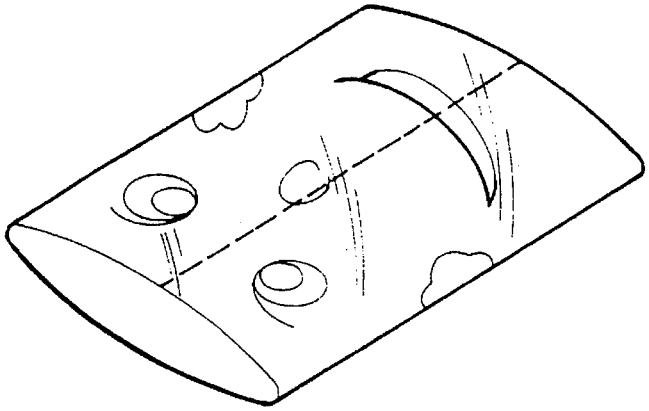
F I G. 2
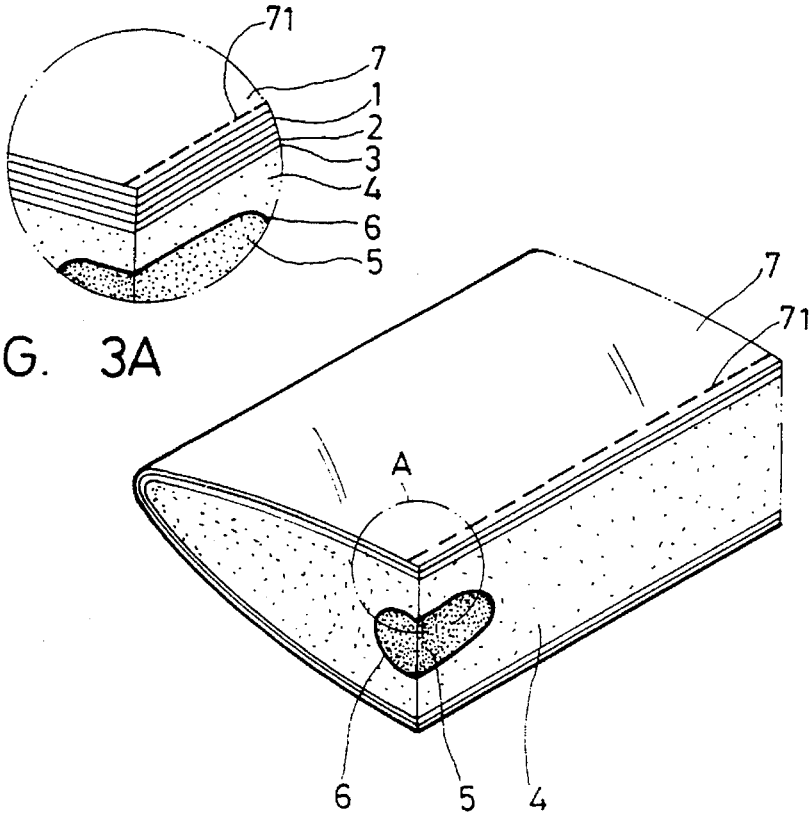
F I G. 3A
F I G. 3

AUTOMATICALLY INFLATABLE TOY

BACKGROUND OF THE INVENTION

Inflatable toys are widely welcomed by the consumers. A conventional inflatable toy usually has an air tap from which air is blown into the toy by means of mouth or some kind of inflator. Blowing air by mouth is time and effort consuming while the inflator is generally clumsy and inconvenient. In addition, the conventional inflatable toy is made of material that has lower tensile strength and is therefore, easily deformed or broken when it is overinflated. These factors have reversely reduced people's interest in the inflatable toys. Moreover, the conventional inflatable toys are made of material which is not edible and not recoverable and are therefore not safe in use while they might cause environmental hazards.

It is therefore tried by the inventor to develop an automatically inflatable toy to overcome the above mentioned drawbacks existed in the conventional inflatable toys.

SUMMARY OF THE INVENTION

The primary object of the present invention is to provide an automatically inflatable toy which is made of material with excellent tensile strength and may thereby constantly maintain its shape after it is inflated without easily becoming leaked or deformed.

Another object of the present invention is to provide an automatically inflatable toy which is completely recoverable without causing any environmental pollution and public hazards.

A further object of the present invention is to provide an automatically inflatable toy which is made of edible material without causing any danger and damage to children and is therefore very safe in use.

The automatically inflatable toy according to the present invention is made of multi-layered laminated material with high density and high tensile strength. The material consists of laminates of nylon, LLDPE, PET, etc. and can have a galvanized coating applied to its inner surface to enable the inflatable toy to sustain a pressure about 3 to 5 atmospheres and has a compression strength about 5 kg per square centimeter. Inside the inflatable toy, an adequate amount of citric acid solution contained in an OPP film bag and an adequate amount of powdered sodium bi-carbonate contained in a PET+PET+CP plastic bag are disposed. When the inflatable toy in a flat state is slightly squeezed, the OPP film bag is broken and the citric acid solution is let out to mix with the powdered sodium bi-carbonate to produce large amount of carbon dioxide which automatically expands the inflatable toy. The inflatable toy so constructed may maintain its shape without leakage or deformation for almost 30 days, and all the materials used to make the toy are edible and recoverable. So, the automatically inflatable toy of the present invention is surprisingly attractive, safe and durable.

BRIEF DESCRIPTION OF THE DRAWINGS

The above and other objects of the present invention as well as the structure, characteristics, and operation thereof can be best understood from the following detailed description of the preferred embodiment and the accompanying drawings, wherein

FIG. 2 is an assembled perspective of the present invention;

FIG. 3 is a fragmentary, sectional view showing the internal structure of the present invention and FIG. 3A is an enlarged sectional view of the Part A of FIG. 3;

DETAILED DESCRIPTION OF THE PREFERRED EMBODIMENT

Figures 1, 1A:
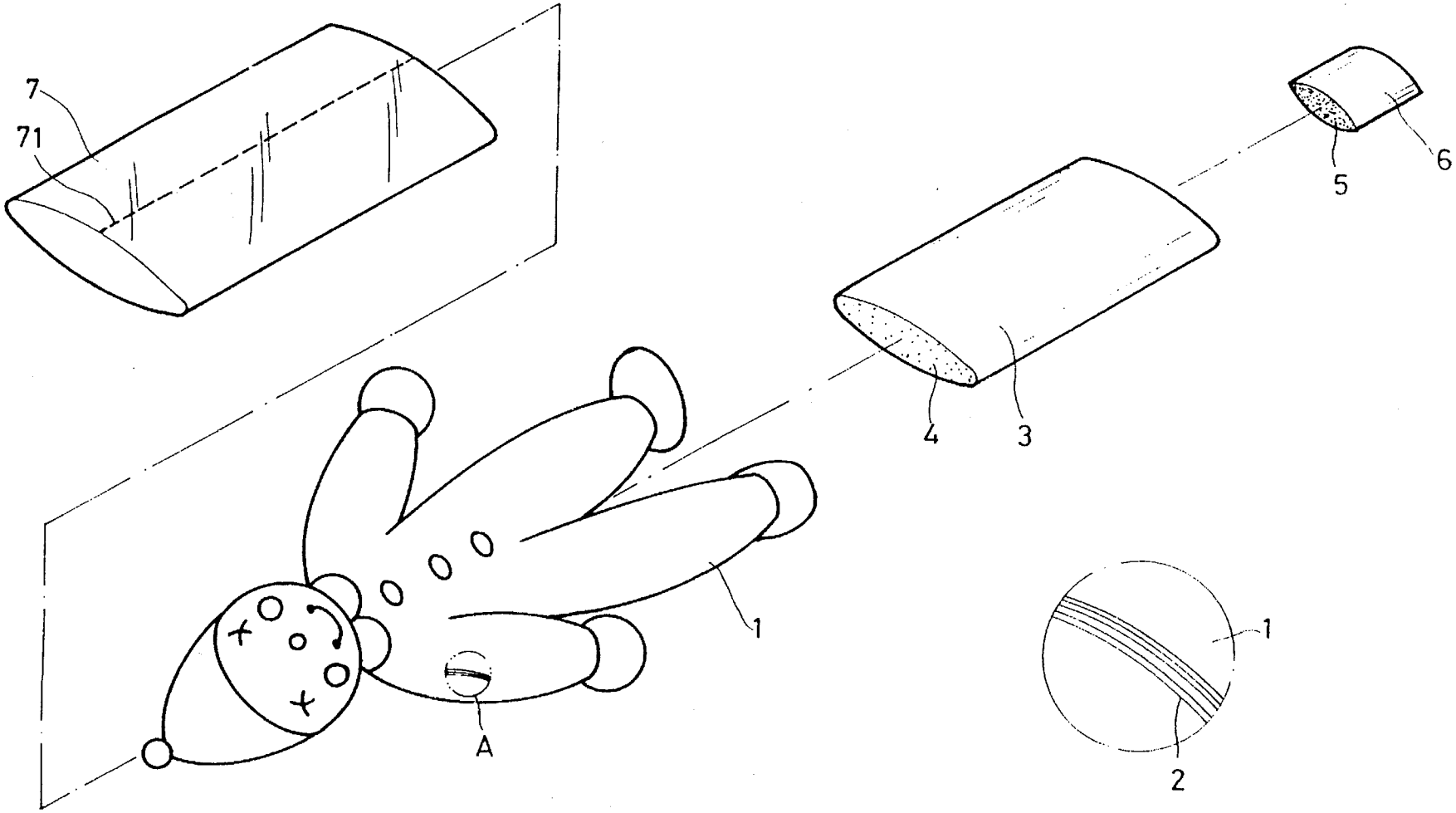
FIG. 1 is an exploded perspective of an embodiment of the automatically inflatable toy according to the present invention.
FIG. 1A is a sectional view showing the laminated layers of the material used to make the inflatable toy of the present invention.

Please refer to FIGS. 1 and 2. The automatically inflatable toy of the present invention mainly includes an inflatable toy 1, an adequate amount of citric acid solution 5 contained in a very thin bag 6, an adequate amount of powder type sodium bi-carbonate 4, and a package 7 into which the inflatable toy 1, the bag 6 and the powder type sodium bi-carbonate 4 are packed.

The inflatable toy 1 is made of a laminated material which consists of multiple thin layers of high intensile strength and high desity plastic materials, such as nylon, LLDPE, and PET. A galvanized coating 2 can be optionally added to an inner surface of the laminated material of the inflatable toy 1 to enhance the airtight property of the laminated material. An inflatable toy 1 made of such laminated material can sustain a pressure of at least 3 to 5 atmospheres without becoming deformed in its appearance or shape. The inflatable toy 1 would not leak for at least 30 days. Since the laminated material according to the present invention can be sealed by means of heat sealing or ultrasonic and heatronic melting, it can be used to form objects of various shape and imprinted on its surface with colorful patterns. The laminated material of the present invention also has a very high tensile strength and a compression strength of 5 kg per square centimeter. The inflatable toy 1 made of such laminated material shall have good softness and resiliency without any harm to any child.

The inflatable toy 1 is provided thereinside with the adequate amount of bagged citric acid solution 5 and the adequate amount of powder type sodium bi-carbonate 4. The citric acid solution 5 is packed in a very thin bag 6 made of compound OPP and PP by means of automatic packing machine. The bag 6 is so thin that it can be easily squeezed to break with fingers. The powder type sodium bi-carbonate 4 and the bagged citric acid solution 5 are together contained in a plastic bag 3 made of, for example, PET+PET and CPP.

To make the toy more interesting and attractive when it is inflated, the package 7 wrapping the inflatable toy 1 made of the laminated material can be designed to have many different shapes, such as a round ball, a lovely heart, a cute baby bear, etc. Furthermore, the package 7 has a weakening line 71 provided on one side thereof at an adequate position.

Figure 4:
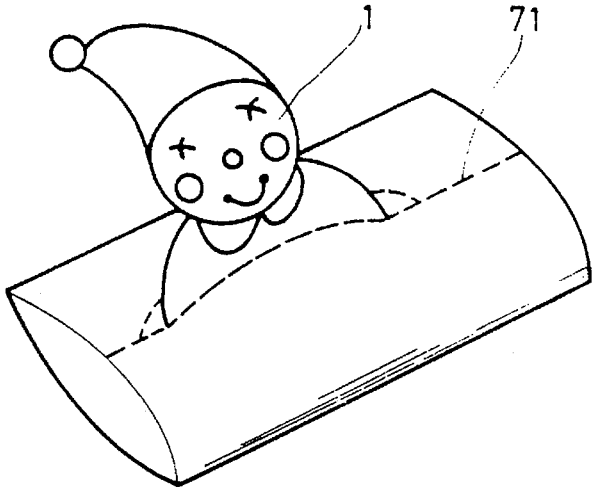
FIG. 4 is the present invention with the automatically inflatable toy gradually pressing its way through a weakening line formed on the package thereof.
Figure 5:
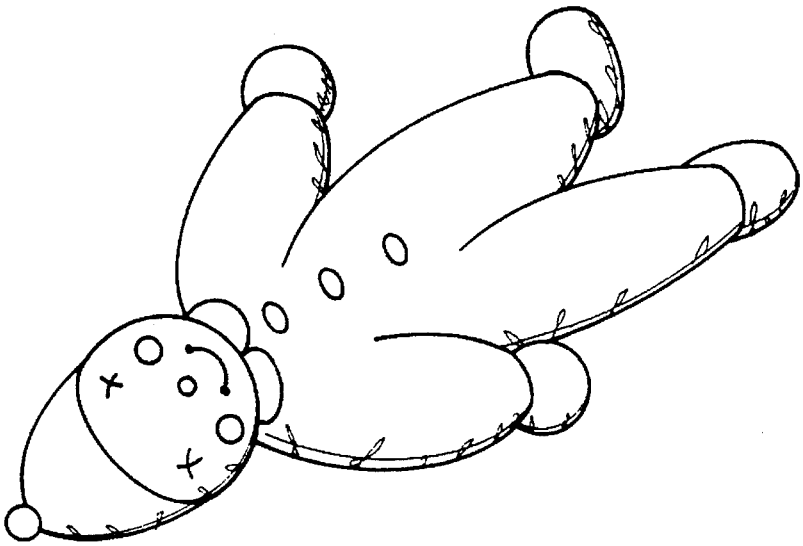
FIG. 5 shows an embodiment of the automatically inflatable toy of the present invention after it has completely come out of the package.

Please refer to FIGS. 3, 4 and 5. To inflate the inflatable toy 1, just slightly squeeze the package 7 with fingers. At this point, the small thin bag 6 is pressed and broken, and the citric acid solution 5 contained in the bag 6 flows out of the bag 6 to mix with the powder type sodium bi-carbonate. A chemical reaction developed between the two mixed chemicals produces carbon dioxide which shall inflate the plastic bag 3 made of PET+PET+CPP wrapping these two chemicals, causing the bag 3 to burst and release large amount of gas which in turn inflates the inflatable toy 1. The inflatable toy 1 keeps expanding and gradually pushes open the outer package 7 from the weakening line 71, as shown in FIG. 4, until the package 7 is completely pushed open and the inflatable toy 1 is completely exposed to the air, giving people, especially small children, the joy of suprise and novelty.

The plastic bag 3 may be replaced with a bag made of porous cotton cloth or non-woven cloth. Gas produced in the chemical reaction developed inside the cotton or non-woven cloth bag 3 may still be freely released from the bag via the pores of the cloth material to inflate the laminated material of the inflatable toy 1. Due to the property of moisture-absorption of the cotton and/or non-woven cloth, an optimal chemical reaction can be developed between the powder type sodium bi-carbonate 4 and the citric acid solution 5 within the bag 3 and thereby largely reduces the bad yield of product.

The outer package 7 can be designed to have many different shapes, such as a round ball, a lovely heart, a figure, a certain kind of animal, etc. The present invention can be alternatively employed to form a toy ball or an advertising balloon to save a lot of space needed in transportation. The present invention may also be used as the stuffing for stuffed toys to reduce the weight of product.

What is to be noted is the multi-layered laminated material for the inflatable toy 1, the thin bag 6, the plastic bag 3, and the package 7, unlike PVC and PVDC films which would release poisonous gas containing chloridion when they mix with citric acid, all are made from materials which can be recovered without causing any environmental hazards. In addition, the multi-layered laminated material for the inflatable toy 1 and the chemicals disposed inside the toy 1 all are edible without any danger or harm to human body.

What is claimed is:

1. An inflatable toy comprising:

an outer package including a weakening line formed therein;

a toy body disposed in said outer package and made of multi-layered laminated material and including an inner surface;

a first bag disposed in said toy body and made of compound materials;

a powder type sodium bi-carbonate material contained in said first bag;

a second bag disposed in said toy body and disposed within said powder type sodium bi-carbonate material;

a citric acid solution disposed in said second bag, said citric acid solution being moved out of said second bag for acting with said powder type sodium bi-carbonate material so as to generate carbon dioxide and so as to inflate said toy body when said second bag is broken; and a galvanized coating applied to said inner surface of said toy body so as to form an air tight seal for said toy body;

said first bag being made of cloth materials for absorbing moisture and for allowing escaping of the carbon dioxide from said first bag to said toy body, and said toy body being movable out of said outer package via said weakening line when said toy body is inflated.

* * * * *